US007001207B2

(12) United States Patent
Boemmel et al.

(10) Patent No.: US 7,001,207 B2
(45) Date of Patent: Feb. 21, 2006

(54) CONTINUOUS RIBBON FOR A CABLE CONNECTOR

(75) Inventors: Christian Otto Boemmel, Langen (DE); Rolf Jetter, Darmstadt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/759,630

(22) Filed: Jan. 16, 2004

(65) Prior Publication Data

US 2004/0192105 A1 Sep. 30, 2004

(30) Foreign Application Priority Data

Jan. 16, 2003 (EP) ..... 03000688

(51) Int. Cl.
*H01R 12/24* (2006.01)

(52) U.S. Cl. ..... 439/495; 439/590; 439/596

(58) Field of Classification Search ..... 439/492, 439/493, 495, 499, 714, 710, 590, 596, 937
See application file for complete search history.

(56) References Cited

U.S. PATENT DOCUMENTS 3,325,769 A * 6/1967 Travis ..... 439/496
3,519,978 A * 7/1970 Taormina et al. ..... 439/596
3,641,482 A * 2/1972 Bretting ..... 439/499
3,999,826 A 12/1976 Yurtin ..... 439/495
4,067,637 A * 1/1978 Narozny ..... 439/634
4,193,659 A * 3/1980 Deverrewaere ..... 439/56
4,225,205 A * 9/1980 Sinclair et al. ..... 439/467
4,376,565 A * 3/1983 Bird et al. ..... 439/681
4,717,360 A * 1/1988 Czaja ..... 439/710
4,813,892 A * 3/1989 Strate ..... 439/681
5,816,845 A 10/1998 Chishima et al. ..... 439/495
5,830,012 A * 11/1998 Ortega et al. ..... 439/590

FOREIGN PATENT DOCUMENTS

DE 100 34 615 A1 2/2002
GB 2 360 397 A 9/2001

* cited by examiner

*Primary Examiner*—Hae Moon Hyeon
(74) *Attorney, Agent, or Firm*—Barley Snyder LLC

(57) ABSTRACT

A connector for a ribbon cable is described having two part plates which are preferably connected to one another via a connection piece. The part plates are therefore preferably integral in design. In the region of the connection piece there are contact slots made in the part plates. Preferably the part plates can be produced in the form of continuous plates and cut as required into the desired width from the continuous ribbon. For assembling the connector a ribbon cable is inserted between the part plates and subsequently the part plates are folded on to one another by means of a simple folding operation and preferably permanently connected to one another by fastening elements.

9 Claims, 5 Drawing Sheets

CONTINUOUS RIBBON FOR A CABLE CONNECTOR

FIELD OF THE INVENTION

The invention relates to a connector for a ribbon cable, a continuous ribbon for the production of a connector for a ribbon cable, and a mating connector for forming an electrical contact with a connector.

BACKGROUND OF THE INVENTION

Ribbon cables are used in various electronic applications to produce an electrically conductive connection. The ribbon cable has the advantage that it requires little space, is flexible and can be produced cheaply. However, the flexible form of the ribbon cable leads to problems in maintaining the electrical contact of the conductive traces. Therefore it is known in the prior art to produce a contact for a ribbon cable to connect to a connector which is inserted into a mating connector. The use of the connector defines the position of the conductive traces so that the conductive traces come into contact with contact elements of the mating connector by the insertion of the connector into a mating connector. The known connectors are relatively complex in construction and consist of two individual parts. This makes it relatively expensive to produce the connector and makes assembling the connector and mounting the ribbon cable in the connector complex.

An object of the invention is to provide a simplified connector for a ribbon cable. A further object of the invention is to provide a mating connector for a simplified connector.

SUMMARY OF THE INVENTION

These and other objects are achieved by means of the connector, and by the mating connector for forming an electrical contact with a connector according to an exemplary embodiment of the invention. The connector consists of two part plates which can be connected to form a connector via fastening elements. At least one part plate has contact openings along a leading edge thereof.

In an exemplary embodiment of the invention, a connector is provided for a ribbon cable, which has conductive traces surrounded at least partially by insulating material, wherein the conductive traces are arranged adjacent to one another and extend to an end region of the ribbon cable. The connector has two part plates. At least one part plate has contact openings along one edge of the part plate for the conductive traces. The part plates also have fastening elements with which the part plates can be connected to form a connector providing a receiving space for arranging the ribbon cable between the two part plates.

BRIEF DESCRIPTION OF THE DRAWINGS

The invention is explained in more detail below by reference to the following figures in which.

DETAILED DESCRIPTION OF THE INVENTION

Figure 1:
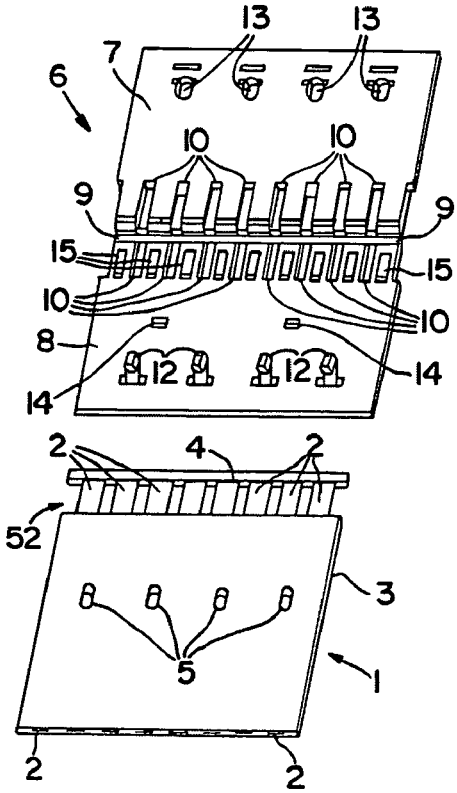
FIG. 1 shows a connector according to an exemplary embodiment of the invention and a ribbon cable in an unassembled state.

FIG. 1 shows an end portion of a ribbon cable 1, which has conductive traces 2, which are surrounded by an electrically insulating layer 3. The conductive traces 2 are insulated along most of the length of the ribbon cable 1, but are exposed in a contact portion 52. The ends of the conductive traces 2 are embedded in an end strip 4. The end strip 4 also comprises the insulating layer 3. The ribbon cable 1 has holes 5, which are positioned between the conductive traces 2, in the insulating layer 3.

An unassembled connector 6 which comprises a first part plate 7 and a second part plate 8 is shown in front of the ribbon cable 1. The two part plates 7, 8 are mutually connected at edges thereof by a flexible connecting portion 9, and thus are integrally formed. The connector 6 may be fabricated of plastic, for example. In the practical example shown, the connecting portion 9 comprises a membrane or living hinge, which connects the two part plates 7, 8 continuously along the associated edges (i.e., on the face end or leading edge of the respective part plates). The membrane or living hinge in the practical example shown takes the shape of a long strip which is arranged between the two part plates 7, 8 and has a reduced stiffness to facilitate bending, such as by reduced thickness. Adjacent to the connecting piece 9, the first and second part plates 7, 8 have contact slots 10. The contact slots 10 of a part plate 7, 8 are arranged parallel to one another. The contact slots 10 of the two part plates 7, 8 respectively are aligned in pairs, the pairs disposed on common axes. Depending on the design of the contact elements with which the conductive traces 2 of the ribbon cable 1 are to come into contact, it may also suffice if only one of the two part plates 7, 8 has contact slots 10. Instead of the membrane or living hinge connecting the two part plates 7, 8 continuously along the entire connecting edge of the part plates, individual connecting webs 11 may alternatively be used which connect the two part plates 7, 8 to one another at the connecting edges at fixed points. The second part plate 8 also has holding recesses 14.

In an alternative exemplary embodiment the connecting element is left out entirely and the connector 6 consists of two part plates 7, 8, which are connected via fastening elements 12, 13 (described below) to one another by means of an assembly operation.

Figure 2:
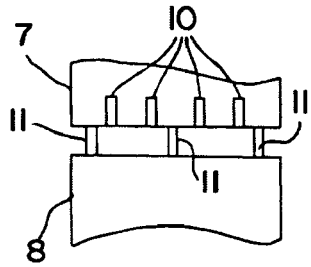
FIG. 2 shows a connector having a plurality of connector portions according to another exemplary embodiment of the invention.

FIG. 2 shows a schematic representation of a corresponding second practical example of a connector in which the two part plates 7, 8 are mutually connected by flexible connecting webs 11. In this practical example, only the first part plate 7 has contact slots 10 as well.

Figure 3:
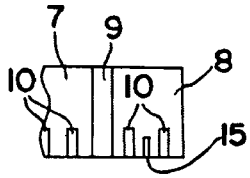
FIG. 3 shows a connector having a side connector portion according to yet another exemplary embodiment of the invention.

From FIG. 1 it can be seen that the second part plate 8 has fastening elements 12, which are pins orientated vertically to the second part plate 8. Instead of the pins, latching elements such as for example latching hooks can also be provided. In mirror symmetry to the connecting portion 9, the first part plate 7 has fastening elements 13, which may for example be pin openings. The second part plate 8 also has holding recesses 14. Instead of the face end (i.e., instead of the leading edge arrangement shown in FIG. 1 and FIG. 2), the flexible connecting portions 9 or connecting webs 11 can be designed at side edges between the first and the second part plate 7, 8, as is shown in FIG. 3.

In a preferred practical example on an internal face of the two part plates, here on the second part plate 8, spacers 15 are provided. The spacers 15 are preferably provided in the form of longitudinal strips which are arranged parallel to one another. The spacers 15 are preferably of a height which is about the thickness of the ribbon cable 1. In addition, the spacers 15 also serve to orientate and align the contact portions 52 of the conductive traces 2. A conductive trace 2 is limited in its lateral motion on each of its opposing sides by one spacer 15, respectively.

Figure 4:
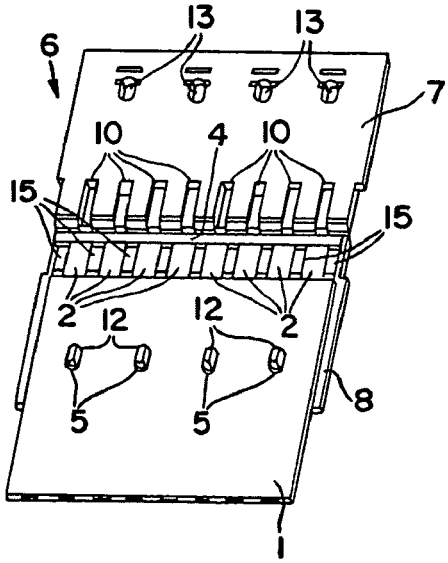
FIG. 4 shows a ribbon cable which is placed into the connector of FIG. 1.

FIG. 4 shows the connector 6 in an unassembled state with the ribbon cable 1 resting on the second part plate 8. The pins 12 grip through the holes 5 of the ribbon cable 1. The conductive traces 2 are arranged between the spacers 15. By means of the arrangement of the spacers 15 the isolated contact regions 52 of the conductive traces 2 are precisely orientated to the position of the slots 10. The end strip 4 rests with a long side at the end faces of the spacers 15. The end faces of the spacers 15 are separated from the connecting edge of the second part plate 8 by the width of the end strip 4. The end strip 4 therefore completely rests on the second part plate 8. The connecting piece 9 preferably has a width which corresponds at least to the height of the end strip 4. The contact slots 10 of the first and second part plates 7, 8 extend to the edge of the first and of the second part plate 7, 8 and thus are adjacent to the connecting piece 9.

Figure 5:
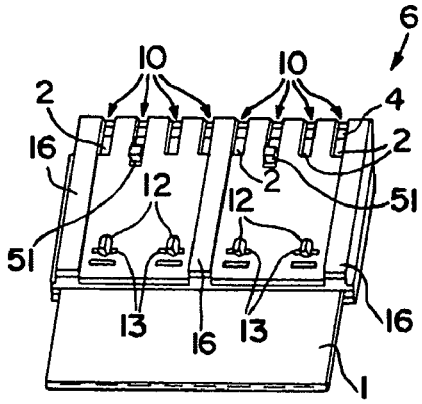
FIG. 5 shows the connector of FIG. 1 in an assembled state.

FIG. 5 shows the connector 6 with the ribbon cable 1 in the assembled state. Here, the first part plate 7 is folded on to the ribbon cable 1. The pins 12 of the second part plate 8 are connected into the pin openings 13 of the first part plate 7 and connect the first part plate 7 permanently to the second part plate 8. Via the contact slots 10 the conductive traces 10 are freely accessible for making contact.

Figure 6:
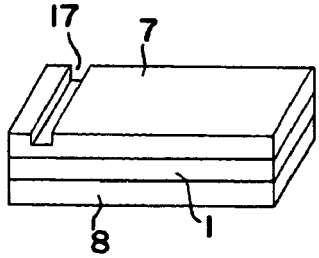
FIG. 6 shows a connector with a guide groove according to an exemplary embodiment of the invention.

In an alternative exemplary embodiment, a conductor line 2 can also be contacted through the insulation layer 3. This is possible for example with cutting contact terminals. In this practical example there does not need to be any isolation of the conductive traces. The first part plate 7 has guide webs 16 on an external surface that are formed parallel to the insertion direction of the connector 6. Instead of the guide webs 16, guide grooves could also be provided. FIG. 6 shows a connector 6 whose first part plate 7 has guide grooves 17.

Figure 7:
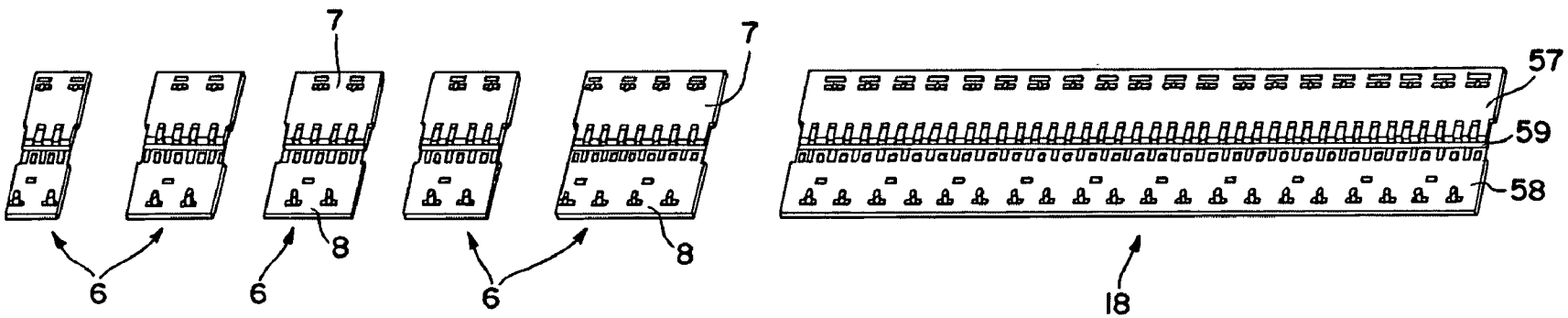
FIG. 7 shows a continuous ribbon for the production of a plurality of connectors according to still another exemplary embodiment of the invention.

FIG. 7 shows a continuous ribbon 18 with first and second continuous part plates 57, 58. The first and second part plates 57, 58 are mutually connected on their leading edges by a continuous connecting piece 59. The first and the second continuous part plates 57, 58 comprise a plurality of integral part plates corresponding to part plates 7, 8 in FIG. 1. Individual connectors 6 may be formed by severing the continuous ribbon 18 at a length corresponding to the width of a particular ribbon cable 1. The continuous ribbon 18 can be cut corresponding to the existing ribbon cable 1 into portions of differing widths, as shown in FIG. 7. In this manner, differing widths of the connector 6 can be manufactured from the continuous ribbon 18. The continuous ribbon 18 can for example be prefabricated in the form of long ribbon portions or in the form of a reeled continuous ribbon. Individual connectors 6 may be separated from the continuous ribbon 18 during manufacture of the connector 6 as a function of the width of the ribbon cable 1 to be connected. The continuous ribbon 18 therefore provides an advantageous pre-product for the manufacture of a connector 6 for a ribbon cable 1. As a rule, however, connectors are manufactured individually with fixed numbers of pins, i.e. a fixed number of conductive traces.

Figure 8:
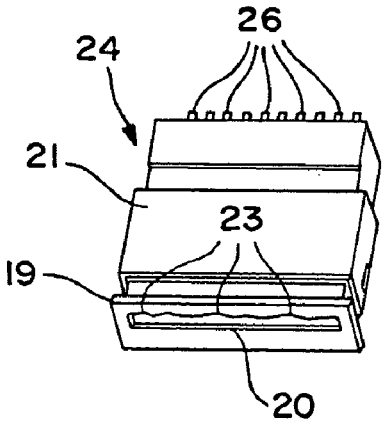
FIG. 8 shows the connector of FIG. 5 and a mating connector according to an exemplary embodiment of the invention in an unmated state.
Figure 8:
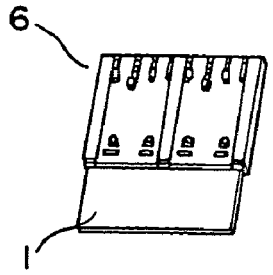

FIG. 8 shows a connector 6 with a ribbon cable 1 and a mating connector 24. The mating connector comprises a housing 21 and a slider 19. Contact elements 26 are inserted into the housing 21, which contact elements 26 are intended to be in electrical contact with the conductive traces 2. The slider 19 has an insertion opening 20 which is adapted substantially to the cross-section of the connector 6 and has second guide grooves 23 for orientation of the connector 6. The slider 19 is shown in FIG. 8 in an open position in which the slider 19 protrudes to a greater extent from the front of the housing 21 relative to a closed position.

Figure 9:
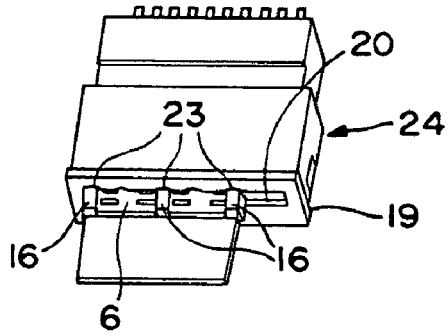
FIG. 9 shows the connector and mating connector of FIG. 8 in a mated state.

FIG. 9 shows the mating connector 24 with an inserted connector 6, the slider 19 being in the closed position. In the closed position the slider 19 is inserted further into the housing 21. When inserting the connector 6 into the slider 19, the guide webs 16 are pushed into the second guide grooves 23. This determines the orientation of the connector 6. In the practical example shown, the connector 6 is narrower than the insertion opening 20. By the provision of the guide webs 16 and of the second guide grooves 23, the position of the connector 6 is determined in a position flush with the left of the insertion opening. This determines the position of the connector 6 which is too narrow. This determines that the contact elements 26 on the left side of the mating connector 24 come into contact. If a 6-pin connector is inserted into an 8-pin mating connector, for example, it is determined that the six contact elements counting from the left side come into contact with the connector 6. However, normally the connector 6 is as wide as the insertion opening 20.

Figure 10:
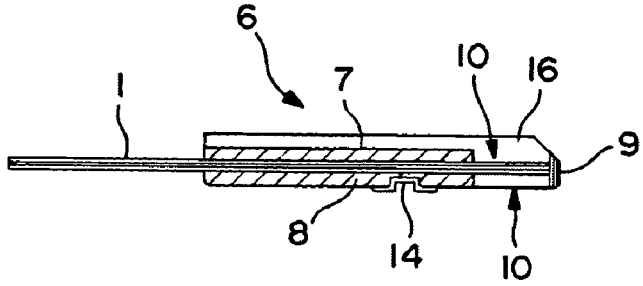
FIG. 10 shows a connector mounted on a ribbon cable according to an exemplary embodiment of the invention in cross-section.

FIG. 10 shows the connector 6 with the ribbon cable 2 in cross-section. The contact slots 10 of the first and of the second part plate 7, 8 are arranged above one another. The contact slots 10 and the connecting piece 9 are clearly visible in cross-section.

Figure 11:
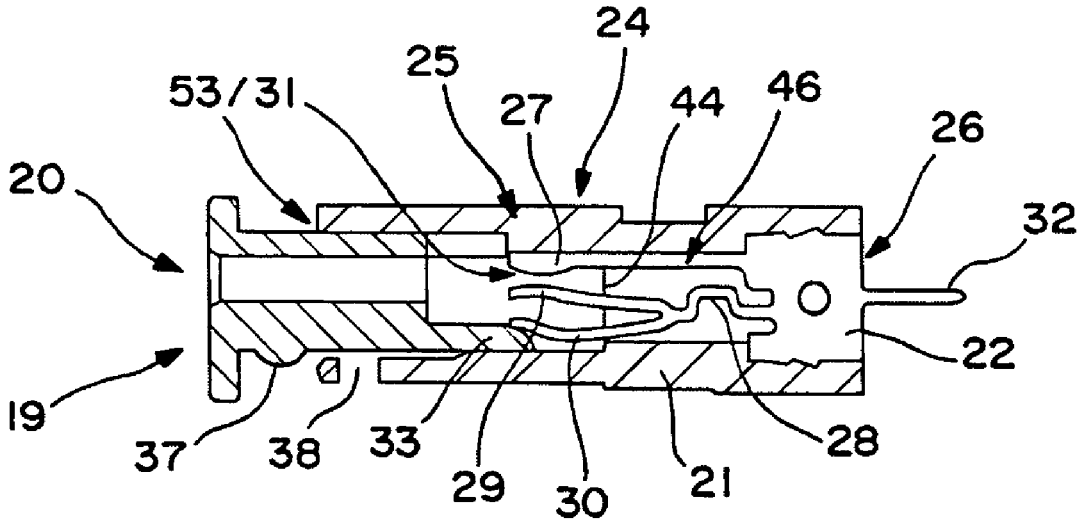
FIG. 11 shows a mating connector according to an exemplary embodiment of the invention in cross section with a slider in an open position.
Figure 12:
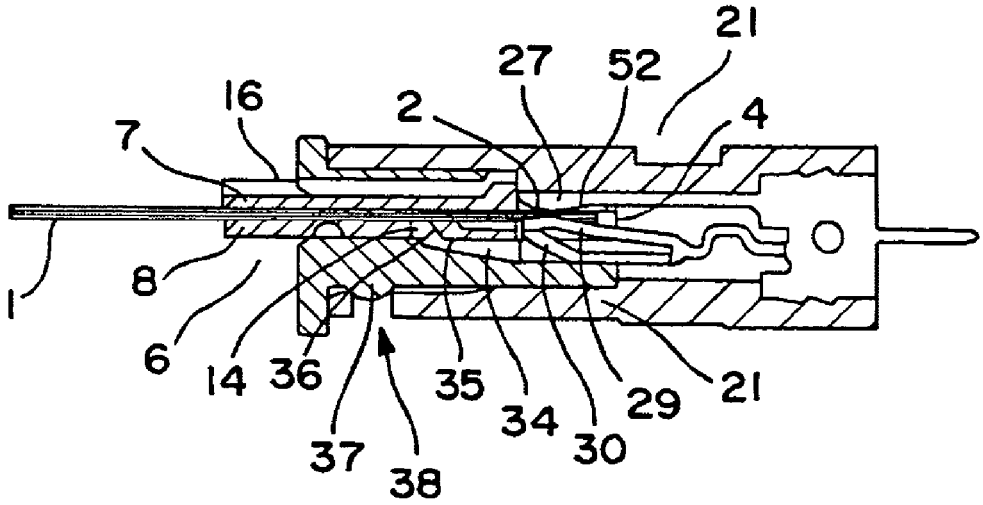
FIG. 12 shows a connector mounted on a ribbon cable mated with a mating connector according to the invention in cross section with a slider in the closed position.

FIG. 11 shows a cross-section through the mating connector 24, which has a contact space 25. Contact elements 26 are held in the housing 21 and protrude into the contact space 25. Each contact element 26 has a contact plate 22 from which a first and a second contact arm 27, 28 extend in the direction of the contact space 25. The second contact arm 28 forks into a third and a fourth contact arm 29, 30. The first, the third and the fourth contact arm 27, 29, 30 are arranged above one another at substantially the same position with respect to the width of the mating connector 24. The third contact arm 29, starting from the second contact arm 28, extends in the direction of the first contact arm 27. The fourth contact arm 30, starting from the second contact arm 28, extends away from the first contact arm 27. A contact region 31 is provided between the first and third contact arm 27, 29. The contact element 26 in addition has a contact pin 32 for making an electrical contact. The slider 19 is axially displaceable in the housing 21 and is arranged in a receiving space 53. The slider 19 shown in FIG. 11 is shown in an open position. In the practical example illustrated, the slider 19 has an actuating arm 33 which is arranged between the housing 21 and the fourth contact arm 30, and preferably slightly pretensions the fourth contact arm 30 with the actuating surface in the direction of the first contact arm 27. In the open position of the slider 19, the connector 6 as shown in FIG. 10 is pushed through the insertion opening 20 of the slider 19 into the contact space 25 of the mating connector 24. The connector 6 is pushed far enough into the contact space 25 for the exposed conductive traces 2 to be arranged in the contact region 31 between the first and the third contact arm 27, 29. Depending on the pretensioning of the fourth and thus of the third contact arm 30, 29, the first and the third contact arm 27, 29 slide at least partially on the upper and lower side respectively of the exposed contact portions of the conductive traces 2. Subsequently the slider 19 is moved from the open position into the closed position. The actuating arm 33 meanwhile slides deeper into the contact space 25 and tensions the fourth contact arm 30 with the actuating surface and thus also the third contact arm 29 in the direction of the first contact arm 27. The conductive traces 2 are therefore pressed by the third contact arm 29 against the first contact arm 27, as illustrated in FIG. 12.

The housing 21 preferably has a holding arm 34 which is arranged between a second actuating surface 35 of the second part plate 8. The second actuating surface 35 is arranged in a fixed angle to the insertion direction of the slider 19. When inserting the slider 19 into the housing 21 into the closed position, the flexible holding arm 34 is bent by the second actuating surface 35 of the slider 19 in the direction of the connector 6. The holding arm 34 has a holding pin 36 which engages with the holding recess 14 of the second part plate 8 when the slider 19 is in the closed position. The connector 6 is thus connected in an interlocking fit via the holding arm 34 with mating connector 24. The holding arm 34 is manufactured from a resilient material so that if the slider 19 moves from the closed position into the open position the holding arm springs back into the original position and the holding pin 36 is thereby moved out of the holding recess 14. Consequently the connector 6 can be pulled away again from the mating connector 24. In the closed position, however, the connector 6 cannot be pulled out of mating connector 24. In the closed position a holding cam 37, which is moulded on an external face of the slider 19, engages with a holding opening 38, which is provided in the housing 21. The slider 19 is therefore held in the closed position. To release the slider 19 from the closed position the holding cam 37 must be pushed out of the holding opening 38.

Figure 13:
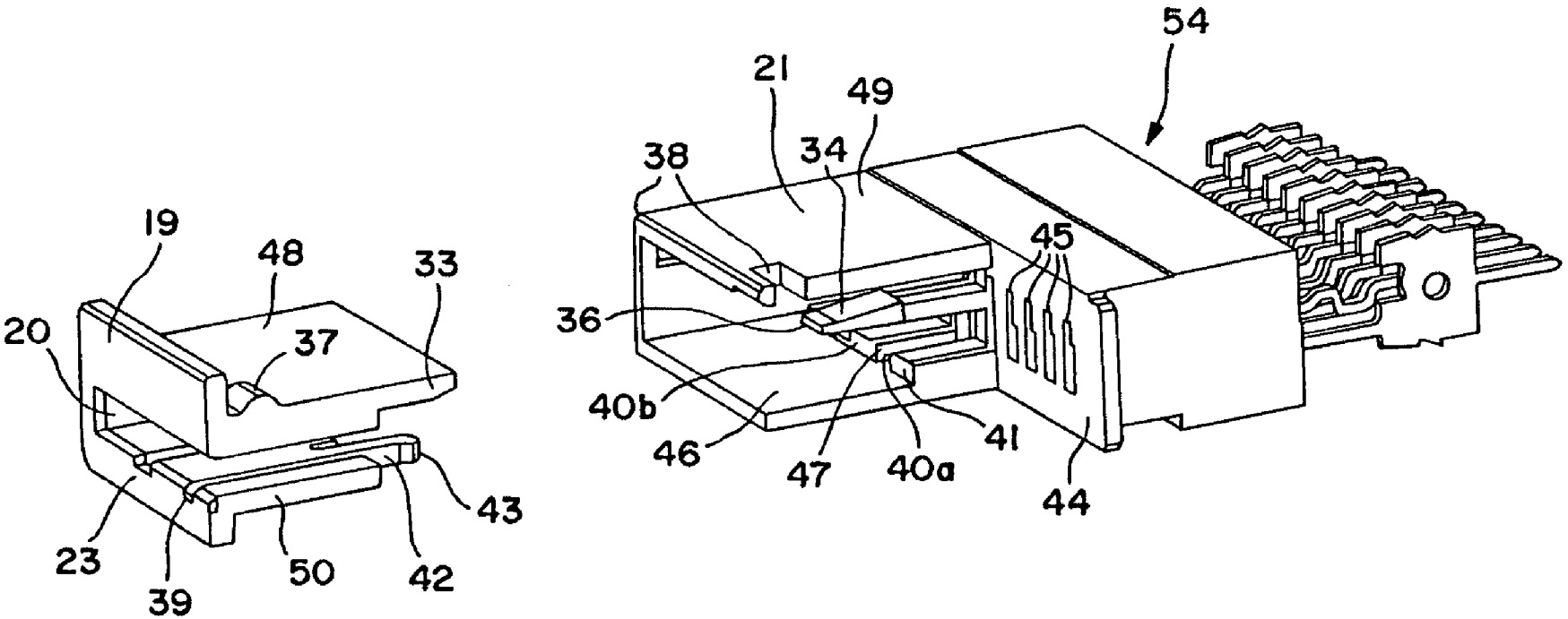
FIG. 13 shows partial section isometric drawings of a slider and a housing for a mating connector with spring contacts according to an exemplary embodiment of the invention.

FIG. 13 shows further details of the housing 21 and of the slider 19 in partial section drawings. The housing 21 has a partition wall 44 into which second slots 45 are made. To assemble the contact elements 26 the contact elements 26 are connected from a reverse side with the first, third and fourth contact arm 27, 29, 30 through the second slots 45 of the partition wall 44. The partition wall 44 therefore separates the contact space 25 from an insertion space 54. Starting from the partition wall 44, the holding arm 34 protrudes into the contact space 25. Additionally, spacer blocks 40*a*, 40*b* are provided on an underside 46 of the housing 21, which extend to the partition wall 44. The two spacer blocks 40*a*, 40*b* form a boundary to an insertion groove 47. The slider 19 has a peripheral frame 48, rectangular in cross-section, which is also guided in the housing 21 in the contact space 25 by a rectangular second frame 49. In the assembled state a second underside 50 of the frame 48 rests on the underside 46 of the frame 49. From the second underside 50 in the insertion direction a second actuating arm 42 extends, which has a lateral lug 43. Adjacent to the side edge of the second actuating arm 42, on to which the lug 43 is moulded, a further guided groove 39 extends along the second underside 50. In the open position, the slider 19 is inserted far enough into the frame 49 until the lug 43 comes into contact with a face end 41 of the first holding block 40*a*. The width of the second actuating arm 42 is also narrower in the region of the lug 43 than the insertion groove 47. If the connector 6 is pushed into the insertion opening 20, an actuating cam 51, which is mounted on the external side of the first part plate 7, slides in the further guide groove 39 up to the lug 43. The actuating cam 51 is arranged on the first part plate 7 such that the actuating cam 51 in an end position bends the lug 43 to the side. In the end position the connector 6 is optimally inserted for making contact with the contact elements 26. The actuating cam 51 bends the second actuating arm 42 far enough to the side for the second actuating arm 42 to rest directly in front of the insertion groove 47. The slider 19 can now be inserted deeper into the mating connector 24 into the closed position. During this insertion, the second actuating arm 42 with the lug 43 slides into the insertion groove 47 until the slider 19 reaches its closed position. Through the arrangement of the actuating cam 51 and of the second actuating arm 42, an optimal position of the connector 6 is sensed before the slider 19 can be moved into the closed position.

What is claimed is:

1. A continuous ribbon configured to be severed to form a plurality of connectors, the ribbon comprising two continuous part plates which are mutually connected by an integral flexible connecting piece extending continuously along a leading edge of the continuous part plates wherein at least one of the plates has contact openings passing through the part plate proximate the leading edge.

2. The continuous ribbon according to claim 1, wherein the two continuous part plates each comprise a plurality of integral part plates; the integral part plates being severable to form a pre-product for the manufacture of individual connectors.

3. The continuous ribbon cable according to claim 2, wherein the integral pan plates are severable to form the pre-product of varying width.

4. The continuous ribbon of claim 1, wherein both part plates have contact openings passing therethrough proximate the leading edge which are opposed to one another when the pre-product is in the assembled state.

5. The continuous ribbon according to claims 1, wherein the part plates are foldable onto each other to form the pre-product with a receiving space therebetween.

6. The continuous ribbon according to claim 5, wherein one part plate has a groove or a web on an external surface thereof which faces away from the receiving space, the groove or web being arranged parallel to an insertion direction.

7. The continuous ribbon according to claim 6, wherein the groove or web is disposed on the external surface such that the continuous ribbon can only be inserted in the correct position of a mating connector having a greater width than the continuous ribbon.

8. The continuous ribbon according to claim 1, wherein at least one of the part plates has spacers on an internal trace thereof which define a gap between the two part plates.

9. The continuous ribbon according to claim 1, wherein the continuous ribbon is disposed on a reel.

* * * * *

UNITED STATES PATENT AND TRADEMARK OFFICE

CERTIFICATE OF CORRECTION

PATENT NO. : 7,001,207 B2
APPLICATION NO. : 10/759630
DATED : February 21, 2006
INVENTOR(S) : Boemmel et al.

It is certified that error appears in the above-identified patent and that said Letters Patent is hereby corrected as shown below:

In column 6, line 49, after "least one of the" insert --part--

In column 6, line 57, "wherein the integral pan plates" should read -- wherein the integral part plates --.

Signed and Sealed this

Tenth Day of October, 2006

JON W. DUDAS
*Director of the United States Patent and Trademark Office*